United States Patent [19]

Kellogg et al.

[11] 4,453,356

[45] Jun. 12, 1984

[54] MODULAR PANEL SYSTEM FOR TEMPORARY BUILDINGS

[75] Inventors: Ronald E. Kellogg; Robert L. Voss, both of Dodge County, Nebr.

[73] Assignee: Kelly Klosure Systems, Fremont, Nebr.

[21] Appl. No.: 392,270

[22] Filed: Jun. 25, 1982

[51] Int. Cl.[3] ..... E04B 7/02

[52] U.S. Cl. ..... 52/293; 52/90; 52/814; 52/537

[58] Field of Search ..... 52/795, 814, 537, 90, 52/588, 801, 336, 478, 293, 294, 127.2

[56] References Cited

U.S. PATENT DOCUMENTS

| | | | |
|---|---|---|---|
| 2,347,756 | 5/1944 | Swenson | 52/293 |
| 3,184,012 | 5/1965 | Fujishima | 52/90 |
| 3,302,342 | 2/1967 | Castleberry | 52/814 |
| 3,919,814 | 11/1975 | Beretta | 52/90 |
| 4,301,628 | 11/1981 | Lowe | 52/90 |

FOREIGN PATENT DOCUMENTS

| | | | |
|---|---|---|---|
| 467209 | 10/1928 | Fed. Rep. of Germany | 52/537 |
| 836777 | 8/1960 | United Kingdom | 52/795 |

*Primary Examiner*—Henry E. Raduazo

*Attorney, Agent, or Firm*—Kokjer, Kircher, Bradley, Wharton, Bowman & Johnson

[57] ABSTRACT

A modular panel system for use in constructing temporary buildings of the type that can be disassembled and transported in disassembled form for erection at a new site. Each panel includes a ribbed sheet of steel secured to a rectangular frame formed by three steel angle members and a channel. The ribs on each panel provide ridges on the outwardly facing surface of the sheet and corresponding grooves on the inwardly facing surface. The panels are bolted together with one rib of each panel closely overlapping one rib of the adjacent panel to provide watertight joints between all panels on the walls and roof of the building. The construction of the panels permits them to be compactly stacked for storage and transport.

6 Claims, 6 Drawing Figures

10
12
14
16
18
20
22
32
44
46
48
50
4.
6.

MODULAR PANEL SYSTEM FOR TEMPORARY BUILDINGS

BACKGROUND AND SUMMARY OF THE INVENTION

This invention relates to relocatable buildings of the type that can be disassembled and transported in disassembled form for reuse at a new site.

Temporary buildings are used at constructions sites and at a wide variety of other locations for a wide variety of purposes. Buildings that are portable are typically transported between sites in fully assembled form, and costly transportation equipment is thus required. Another known type of portable building can be partially folded to a storage position, thereby reducing somewhat the bulk of the building during transport. However, the transportation costs are still considerable, and the building is fixed in size and cannot be used if a larger or smaller building is required at the new site. Another problem with existing portable buildings is that long braces and other complicated structural members are necessary in order to provide the building with enough strength to withstand the loads that are applied.

In the past, modular panel building systems have been proposed, some for permanent buildings and others for temporary buildings that can be easily dismantled, as disclosed in U.S. Pat. No. 3,555,754 to R. E. Kellogg. Although the arrangement shown in the Kellogg patent is entirely satisfactory for most applications, the construction of particularly large buildings (those over about 20 feet wide) requires the use of auxiliary structures such as columns, roof purlins and/or trusses. Other known temporary buildings require like auxiliary structural members. None of the known building systems employing modular panels are capable of providing a watertight building, and inclement weather can create leakage problems.

The present invention is directed to an improved temporary building structure and has, as its primary object, the provision of a modular panel system from which a strong and watertight temporary building can be constructed. In accordance with the invention, each modular panel is rectangular and includes a rigid frame formed by three steel angles and a channel member. Secured to the frame of each panel is a ribbed steel sheet which, along with the sturdy frame, provides improved strength characteristics that eliminate the need for special structural members when large buildings are erected. The sheet of each panel includes a projecting rib that overlaps with the first rib of the adjacent panel so that watertight joints are provided when the panels are bolted together and assembled during erection of the building. The unique construction of the panels permits them to be stacked in a compact arrangement for storage and transport.

DESCRIPTION OF THE DRAWINGS

In the accompanying drawings which form a part of the specification and are to be read in conjunction therewith, and in which like reference numerals are employed to indicate like parts in the various views.

DETAILED DESCRIPTION OF THE INVENTION

Figure 1:
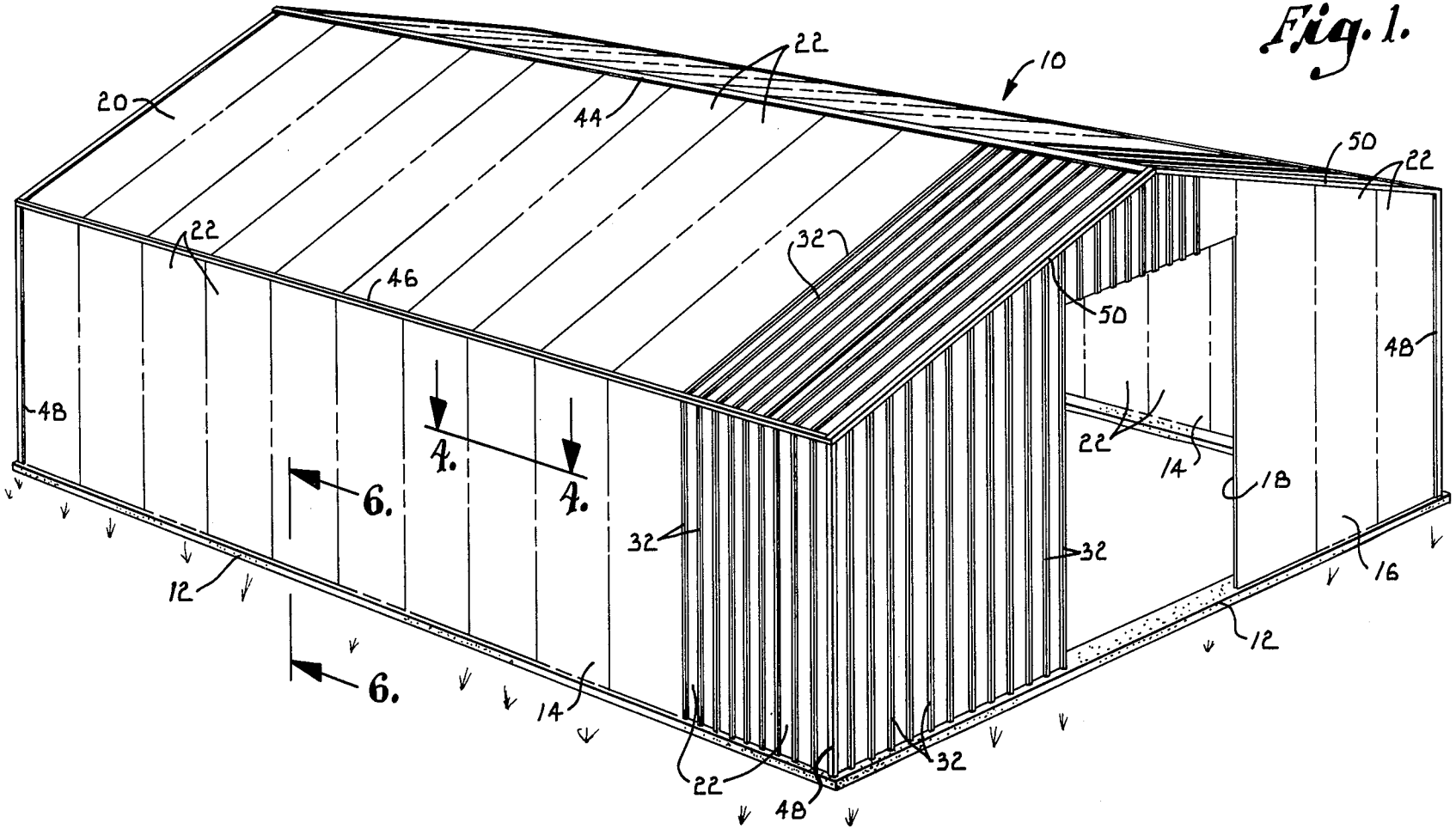
FIG. 1 is a perspective view of a temporary building which is constructed according to the modular panel system of the present invention.

Referring now to the drawings in more detail, FIG. 1 illustrates a temporary relocatable building which is generally designated by reference numeral 10. The building 10 is erected on a concrete footing 12 which extends around the perimeter of the building. Standing on the footing 12 are opposite side walls 14 of the building and opposite end walls 16, one or both of which may be provided with a doorway 18. The building shown in FIG. 1 has a peaked roof 20, and each of the end walls has a gable. It should be understood that the building shown in FIG. 1 is presented by way of example only and that the building can have many sizes and shapes.

Figures 2, 3:
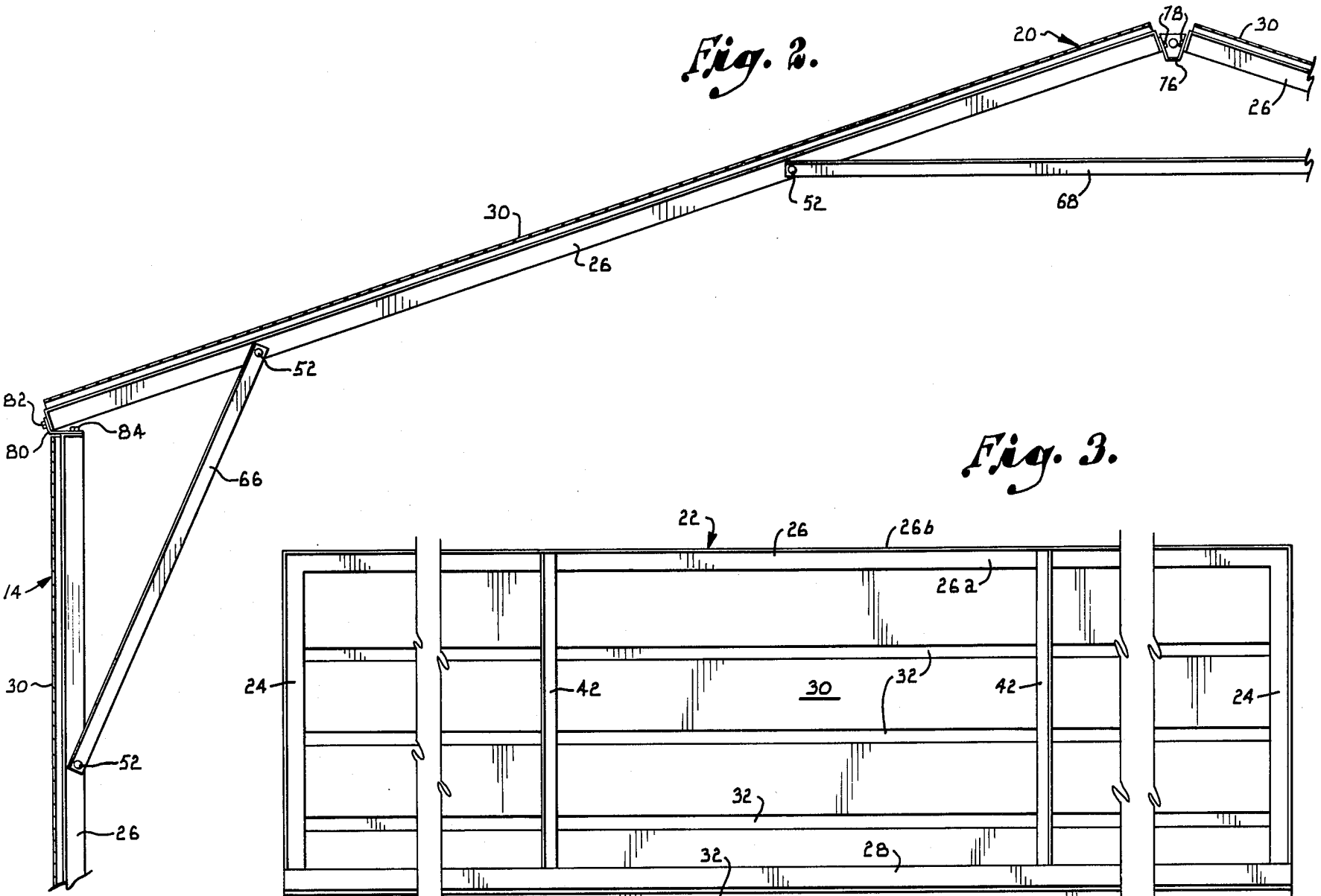
FIG. 2 is a fragmentary sectional view on an enlarged scale showing a portion of the roof and one side wall of the building.
FIG. 3 is a plan view of the inside surface of one of the panels of the building, with the broken away portions indicating continuous length.
Figure 4:
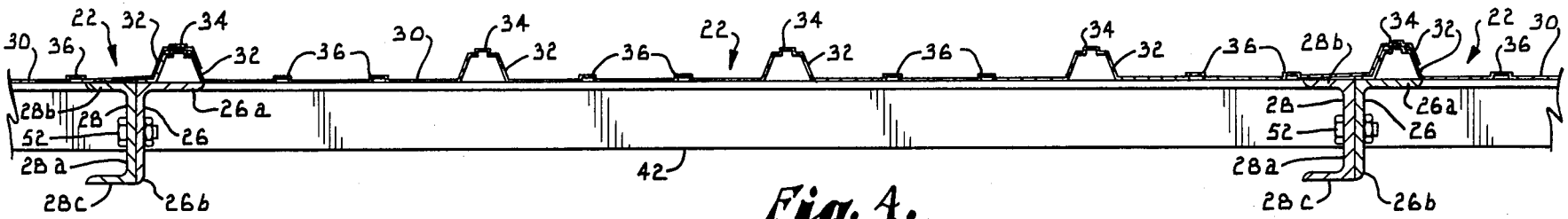
FIG. 4 is a fragmentary sectional view on an enlarged scale taken generally along line 4—4 of FIG. 1 in the direction of the arrows.

Referring now more particularly to FIGS. 2–4, the building 10 is constructed by bolting together a plurality of rectangular panels each designated by numeral 22. Each panel 22 is constructed in the same manner (although the panels can differ in size). Each panel includes an open rectangular frame formed by a pair of steel angle members 24 on the opposite ends of the panel, a longer steel angle member 26 on one side of the panel, and a steel channel 28 on the other side of the panel. The angles and channel are suitably secured to one another to provide a rigid rectangular frame on the margin of each panel.

Each angle 26 includes a pair of perpendicular flanges **26*a* and 26*b*, and the end angles 24 have similar flanges. Flange 26*b* terminates in a free edge. Each channel 28 includes a central web 28*a* having the same depth as flange 26*b* of the opposing angle. Each channel has two parallel flanges 28*b* and 28*c*, and flange 28*b* lies in a common plane with flange 26*a*** of the opposing angle.

A galvanized steel sheet 30 is fastened by rivet or screw to the frame or each panel. Each sheet 30 spans its frame and is preferably fastened to the outer surfaces of flanges **26*a* and 28*b* and to the corresponding flanges of the end angle members 24. Each sheet is preferably formed from 29 guage galvanized steel sheet having high tensile strength, although other materials such as fiberglass can also be employed. A plurality of relatively large ribs 32 extend lengthwise on each sheet 30. Each rib 32 forms a ridge on the outwardly facing side of the sheet and a corresponding groove on the inwardly facing surface of the sheet. Extending along the ridge of each rib 32 is a small stiffener portion 34 of the rib which adds to its strength and minimizes dimpling of the rib. The large or major ribs 32 are spaced apart from one another, and a pair of smaller ribs 36 extend lengthwise on the outer surface of the sheet between each adjacent pair of major ribs 32**.

Figure 5:
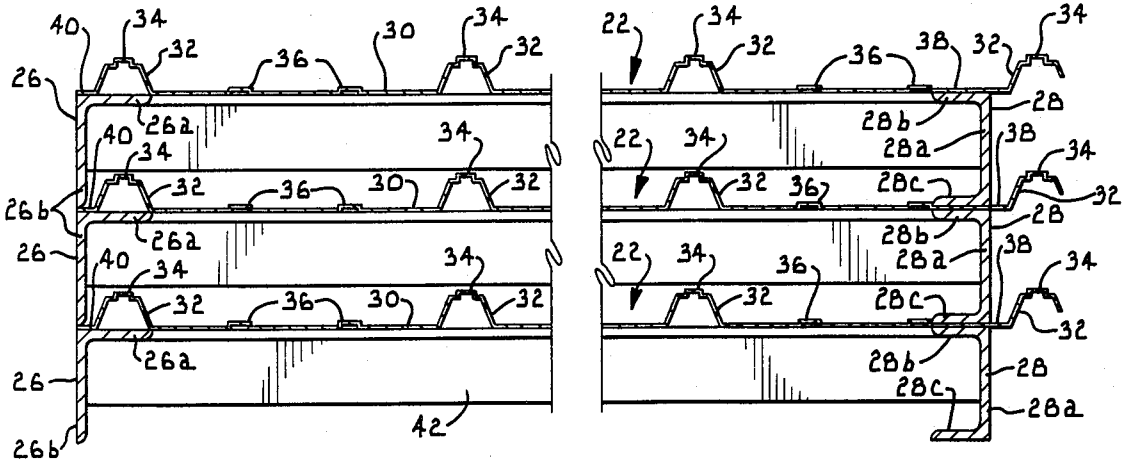
FIG. 5 is a sectional view showing a number of disassembled panels stacked on one another for transport or storage in a compact arrangement.

The edge portion of each sheet 30 located adjacent to channel 28 on one side of the panel extends beyond the channel, as best shown in FIG. 5. Included on the projecting edge portion of each sheet is one of the ribs 34. A flat portion 38 of sheet 30 is secured to flange 28*b* of the channel and is located adjacent to the rib 34 that projects beyond the channel. The initial rib 34 located on the side of the panel opposite the projecting rib extends along flange 26*a* of angle 26. The edge portion of sheet 30 adjacent to the initial rib presents a flat surface 40 which is located adjacent to the intersection between flanges 26*a* and 26*b* of the angle member.

Cross braces 42 in the form of steel angles extend between the angle 26 and channel 28 of each panel. The braces 42 are parallel to one another and to the angle members 24 on the opposite ends of the panel.

The building 10 is constructed by bolting the panels 22 together side by side to provide the side walls 14, end walls 16 and roof 20. As shown in FIG. 1, conventional ridge flashing 44 is applied to the peak of the roof, conventional eave flashing 46 is applied to the eaves, conventional corner flashing 48 is applied to the corners of the building, and additional flashing 50 is applied to the intersections between the roof and the end wall gables.

In assembling the building, one of the end walls 16 is preferably assembled in a flat condition on the ground. The panels forming the end wall gables are constructed generally like the rectangular panels, although their shape is altered to comform with the shape of the gables. The panels are arranged with the channel web 28*a* of one panel against flange 26*b* of the adjacent panel, and the channel 28 and angle 26*b* are bolted together by a plurality of conventional bolts 52, as best shown in FIG. 4. The rib 34 which projects beyond the channel of each panel overlaps the initial rib which extends along flange 26*a* of the adjacent panel, also as shown best in FIG. 4. The grooves presented by the projecting rib overlaps and closely receives the ridge of the initial rib of the adjacent panel in order to provide a watertight joint between each pair of panels.

Figure 6:
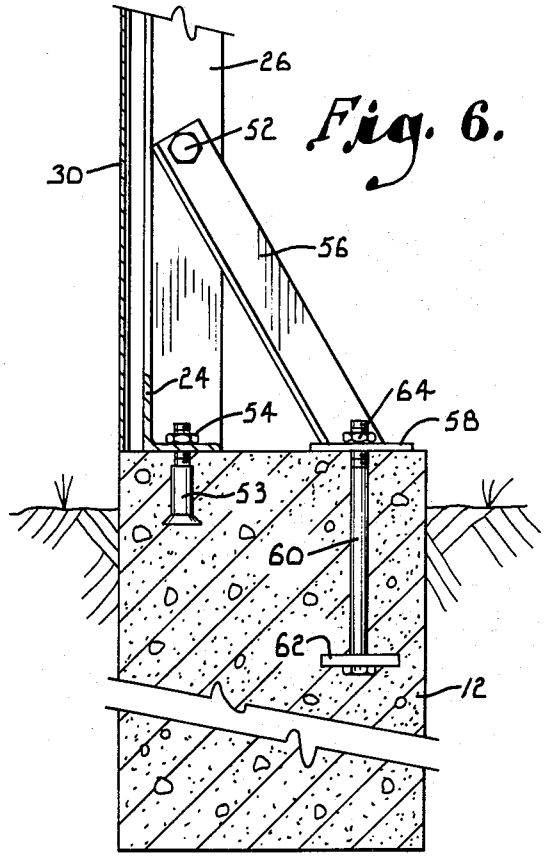
FIG. 6 is a fragmentary sectional view on an enlarged scale taken generally along line 6—6 of FIG. 1 in the direction of the arrows.

After the end wall has been assembled in the manner indicated, one panel of each side wall 14 can be secured to it and one roof panel on each side of the peak of the roof can be secured to the side wall panel and to the end wall. A crane or the like (not shown) can then be used to raise the assembled portion of the building onto the footing 12, and the wall panels can be secured to the footing in the manner best shown in FIG. 6. The lower flange of the bottom angle 24 of each panel is provided with a series of holes which receive concrete expansion bolts 53 secured in the concrete footing 12. A nut 54 can be threaded onto each bolt 53 in order to secure the wall panels to the concrete footing of the building.

Panels can then be added to each side wall 14 one at a time, and a roof section comprising two roof panels on opposite sides of the peak can be raised and secured to each pair of side wall panels and to the adjacent roof section. This procedure is repeated until the side walls and roof are completed, at which time the preassembled opposite end wall of the building is raised and secured to the roof and to the ends of the side walls.

Referring again to FIG. 6, a plurality of footing braces 56 brace the side walls of the building. Each brace 56 is an angle member, and there is one footing brace provided for each joint between adjacent panels of the side walls. Each footing brace 56 has a base 58 in the form of a flat plate which is welded to the bottom of the brace. An anchor bolt 60 is embedded in the concrete footing and provided with a washer 62 adjacent its head. The threaded end of bolt 60 projects above the concrete footing and through an opening in the base plate 58. A nut 64 is threaded onto bolt 62 secure the footing brace 56 to the concrete footing.

Each footing brace 56 extends upwardly at an angle and connects at its top end with the corresponding angle member 26. One of the bolts 52 which connects angle 26 with the adjacent channel 28 may be used to secure the upper end of the footing brace 56.

Referring now to FIG. 2 in particular, a plurality of knee braces 66 and ridge braces 68 are connected with the joints between adjacent panels. Each knee brace 66 is bolted by one of the bolts 52 to the angle member 26 located at the corresponding joint of the side wall of the building. The upper end of each knee brace is bolted by another of the bolts 52 to the angle member located at the corresponding joint on the roof section of the building. Each ridge brace 68 extends horizontally, and its opposite ends are bolted by bolts 52 to the roof panels located on opposite sides of the peak of the roof. The adjacent roof panels on opposite sides of the peak of the roof are connected at the ridge by a channel shaped connector 76 which is bolted at 78 to the angle members 24 on the ends of the panels. A special angle shaped connector 80 connects the lower ends of the roof panels with the upper ends of the side wall panels. Connector 80 is bolted to the roof panels at 82 and to the side wall panels at 84.

When the building has been fully erected, all of the joints between the panels of the side walls 14, the end walls 16 and the roof 20 are watertight joints provided by the overlapping ribs 34. The major ribs 34 and the smaller ribs 36 provide the panels with enhanced strength, and the ribs are located on the outwardly facing surfaces of the panels so that the grooved areas on their inwardly facing surfaces are not exposed to the elements. The only joints on the walls of the buildings are the watertight joints provided by the overlapping ribs, and the only joints on the roof are the watertight joints provided by the overlapping ribs that extend from the eave to the ridge of the roof. The conventional flashing that is applied to the building is likewise watertight so that there is no leakage of water into the building.

In a preferred form of the invention, each panel 22 is 3 feet wide. A building having a length of 36 feet and a width of 30 feet can be constructed by connecting twelve panels together on each side wall and ten panels together on each end wall. Each half of the roof is formed by twelve panels having a length which depends upon the pitch of the roof. It is contemplated that panels having five or six different lengths will be provided, since buildings having a wide variety of sizes can be constructed from such panels (along with appropriate gable fillers). The modular panel construction provides wide versatility in the size of the building that can be erected, as well as facilitating manufacture of the panels.

Due to the strength exhibited by the panels, large buildings can be constructed without the need for special structural members such as columns, trusses, or roof purlins. The necessary structural stength is incorporated in the panel itself, so that the only braces that are needed are the footing braces 56, the knee braces 66 and the ridge braces 68. Braces of this type are economical and can be assembled and disassembled quickly and easily. The strength of the panels is due to the relatively large steel angles 24 and 26 that form three side of the frame and particularly to the channel 28 forming the other side of the frame. Additionally, the ribbed sheet 30 enhances the panel strength.

Disassembly of the building and transport of the panels to a different site can be accomplished without difficulty. Disassembly is achieved simply by removing the bolts which hold the panels together and those which hold the braces and connect the wall panels to the footing. The panels can be shipped in a compact storage position due to the manner in which they are constructed. As shown in FIG. 5, the panels stack in a compact fashion on top of one another. In the stacked position, the lower flange 28*c* of each channel is received on the flat surface 38 of the underlying sheet 30 and directly above the upper flange 28*b* of the underlying channel. The lower edge of each flange 26*b* is received on the underlying flat surface 40 and is supported on the underlying angle 26. Thus, the panels can be stacked in a compact and stable arrangement without interference from the ribs 34 and 36 and without the possibility of the ribs being bent or otherwise damaged.

From the foregoing it will be seen that this invention is one well adapted to attain all the ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A temporary building structure which can be disassembled and transported in disassembled form for erection at different sites, said building structure comprising:

a plurality of panels each having a generally rectangular frame on the margins thereof;

a pair of side members on said frame each having a generally flat flange and a generally flat plate portion oriented substantially perpendicular to said flange, the side members of adjacent panels being located and arranged to be positioned against one another with the plate portions thereof directly against one another to secure the adjacent panels side by side for formation of the building structure;

a pair of end members on said frame interconnecting said side members, each end member having a generally flat flange and the flanges of said side and end members being substantially coplanar;

a sheet of facing material for each panel secured to the flanges of said side and end members to span the frame of the panel, each sheet having a plurality of ribs thereon extending generally parallel to said side members and providing ridges on an outwardly facing surface of the sheet and corresponding grooves on an inwardly facing surface of the sheet;

detachable fastening means for securing the plate portions of adjacent panels directly against each other to connect the panels in a configuration defining the building structure; and an edge portion of each sheet extending beyond one side member of the frame and overlapping the adjacent sheet when the plate portions of the adjacent panels are secured together, said edge portion of each sheet having one rib thereon which overlaps a mating rib located adjacent the other side member on the adjacent sheet in a manner whereby the ridge of said mating rib is closely received in the groove of said one rib to provide a watertight joint between each pair of adjacent panels.

2. The invention of claim 1, wherein the frame of each panel includes:

a channel member forming said side member of the frame beyond which said edge portion of the sheet extends, each channel member having a first flange to which the sheet is secured; and a first angle member forming the other side member of the frame opposite the channel member and second and third angle members forming the end members of the frame, each angle member having one flange to which the sheet is secured.

3. The invention of claim 2, wherein:

said channel member has a second flange spaced from and generally parallel to said first flange thereof;

said first angle member has another flange generally perpendicular to said one flange and terminating in a free edge;

said mating rib of each sheet overlies said one flange of the first angle member; and said sheet presents a generally flat surface of sufficient size to receive said free edge thereon, said flat surface being located adjacent the intersection between the flanges of said first angle member, whereby the panels can be stacked on one another for storage with the free edge on the first angle member of each panel being received on said flat surface of the underlying sheet and said second flange of each channel member being received on the underlying sheet at a location immediately above the first flange of the underlying channel member.

4. A reusable temporary building of the type that can be disassembled and transported in disassembled form for reassembly at a different site, said building comprising:

a plurality of panels each having a frame formed by a pair of end frame members on opposite ends of the frame, a side frame member on one side of the frame and a channel member on the side of the frame opposite said one side, each side frame member being an angle member having mutually perpendicular flanges and each channel member having generally parallel first and second flanges spaced apart from one another and interconnected by a web;

a sheet of facing material or each panel secured to said end frame members and to one flange of said angle member and to the first flange of said channel member;

a plurality of ribs on each sheet extending lengthwise thereon and providing ridges on an outwardly facing surface of the sheet and corresponding grooves on an inwardly facing surface of the sheet, the ribs on each sheet including a first rib adjacent said one flange of said angle member;

a plurality of removable fasteners for detachably connecting the channel member of each panel to the side frame member of an adjacent panel to connect the panels side by side in a manner to provide interconnected walls and a roof of the building;

said sheet having a first flat portion adjacent the intersection between the flanges of said angle member, said first flat portion having sufficient size to receive a free edge of the other flange of said angle member; and said sheet having a second flat portion to which said first flange of the channel member is secured, whereby the panels can be disassembled and stacked on one another with the free edge of the angle member of each panel received on said first flat portion of the underlying sheet and said second flange of each channel member received on said second flat portion of the underlying sheet.

5. The invention of claim 4, including:

a footing for receiving the walls of the building;

detachable fastening means for connecting one end frame member of each panel on each wall to said footing;

a plurality of fasting braces each having opposite ends;

detachable fastening means for connecting one end of each footing brace to said footing; and detachable fastening means for connecting the opposite ends of said footing braces to the connected channel members and side frame members of the adjacent panels on the walls of the building, one brace being connected to each joint between adjacent panels on the walls of the building.

6. A building panel structure for use in constructing a temporary building which can be disassembled and transported in disassembled form for erection at different sites, said panel structure comprising:

a rigid frame having a substantially rectangular shape;

a pair of generally parallel side members on said frame forming opposite sides thereof, each side member having a generally flat flange and a generally flat plate portion substantially perpendicular to said flange;

the plate portion of each side member being adapted for placement directly against and detachable connection directly to the plate portion of a side member of another panel structure to detachable secure the panel structures side by side for formation of the building;

a pair of rigid end members on said frame forming opposite ends thereof and interconnecting the side members of the frame, each end member having a generally flat flange with the flanges of the side and end members being substantially coplanar;

a sheet of facing material secured to the flanges of said side and end members to span the frame, said sheet having a plurality of ribs thereon extending generally parallel to said side members and providing ridges on an outwardly facing surface of the sheet and corresponding grooves on an inwardly facing surface of the sheet; and a side edge portion of said sheet extending beyond the plate portion of one side member of the frame, said edge portion having one rib thereon which overlaps a mating rib on the sheet of another panel structure when side members of the panels are connected to one another, whereby the ridge of the mating rib is closely received in the groove of said one rib to provide a watertight joint between the connected panels.

* * * * *